US008227960B2

(12) United States Patent
Huang

(10) Patent No.: US 8,227,960 B2
(45) Date of Patent: Jul. 24, 2012

(54) LED PROJECTOR LAMP WITH IMPROVED STRUCTURE OF RADIATION FINS

(76) Inventor: Tsung-Hsien Huang, I-Lan Hsien (TW)

( * ) Notice: Subject to any disclaimer, the term of this patent is extended or adjusted under 35 U.S.C. 154(b) by 216 days.

(21) Appl. No.: 12/722,515

(22) Filed: Mar. 11, 2010

(65) Prior Publication Data

US 2011/0221323 A1 Sep. 15, 2011

(51) Int. Cl.
*H01J 1/02* (2006.01)

(52) U.S. Cl. ..... 313/46; 362/294

(58) Field of Classification Search ..... 313/46; 362/294, 249.02, 373, 345, 649–650; 165/80.3, 165/182

See application file for complete search history.

(56) References Cited

U.S. PATENT DOCUMENTS

2009/0147520 A1* 6/2009 Liu et al. ..... 362/294
2009/0279314 A1* 11/2009 Wu et al. ..... 362/373
2010/0237760 A1* 9/2010 Yang ..... 313/46

* cited by examiner

*Primary Examiner* — Anne Hines
(74) *Attorney, Agent, or Firm* — Pai Patent & Trademark Law Firm; Chao-Chang David Pai

(57) ABSTRACT

An LED projector lamp includes a heat sink base holding a light source at the bottom side thereof; radiation fins radially arranged around the heat sink base, each radiation fin having one or multiple light shades that surround the periphery of the heat sink base to prevent light leakage and access of flies and vermin to the inside of the heat sink base and increase heat dissipation surface area; and an electric connector affixed to the radiation fins at the top and electrically connected with the light source at the heat sink base.

4 Claims, 4 Drawing Sheets

LED PROJECTOR LAMP WITH IMPROVED STRUCTURE OF RADIATION FINS

BACKGROUND OF THE INVENTION (a) Field of the Invention

The present invention relates to LED projector lamps and more particularly to such an LED projector lamp that is equipped with an improved structure of radiation fins that have light shades constituting a light shielding wall to prevent light leakage and access of flies and vermin to the inside of the heat sink base thereof.

(b) Description of the Prior Art

Commercial LED (light emitting diode) projector lamps have a low power consumption characteristic. However, the working temperature of the LEDs of an LED projector lamp is limited to a small temperature range. Heat dissipation is quite important to an LED projector lamp. Conventional LED projector lamps commonly use a heat sink base for holding the LED light source. The heat sink bases of conventional LED projector lamps are common cast from metal. These metal heat sink bases are heavy and expensive.

Further, in order to enhance heat dissipation, radiation fins may be used in LED projector lamps and attached radially around the cylindrical heat sink base for quick dissipation of waste heat from the plurality of light emitting diodes of the light source that is bonded to the bottom wall of the heat sink base.

FIG. 6 shows an LED projector lamp with radiation fins according to the prior art. According to this design, a gap A is left between every two adjacent radiation fins 10. The heat sink base 20 shields a part of upward light during operation of the LED projector lamp. However, a part of upward light leaks through the gap A between every two adjacent radiation fins 10. Further, dust, flies and vermin may enter the inside of the heat sink base through the gap A between adjacent radiation fins 10.

Further, the aforesaid radiation fins 10 are thin metal sheet members, the sharp outer edge of each of the radiation fins 10 may injure the user's hands accidentally. Therefore, an improvement in this regard is necessary.

SUMMARY OF THE INVENTION

The present invention has been accomplished under the circumstances in view. It is the main object of the present invention to provide an LED projector light, which effectively prevents light leakage and access of flies and vermin to the inside of the heat sink base thereof.

To achieve this and other objects of the present invention, an LED projector light comprises a heat sink base, a plurality of radiation fins radially arranged around the heat sink base, an electric connector affixed to the radiation fins and a light source electrically connected to the electric connector. Each radiation fin has at least one light shade extending from an inner side near a bottom side thereof. The light shades of the radiation fins are arranged around the periphery of the heat sink base to form a light shielding wall that shields the heat sink base against light leakage and prevents access of flies and vermin to the inside of the heat sink base. The heat sink base has a light source bonded to the bottom wall thereof. The electric connector is affixed to the radiation fins at the top side above the heat sink base.

Further, each radiation fin has a folded outer edge, so that it will not cause accidental injury.

DETAILED DESCRIPTION OF THE PREFERRED EMBODIMENTS

Figure 1:
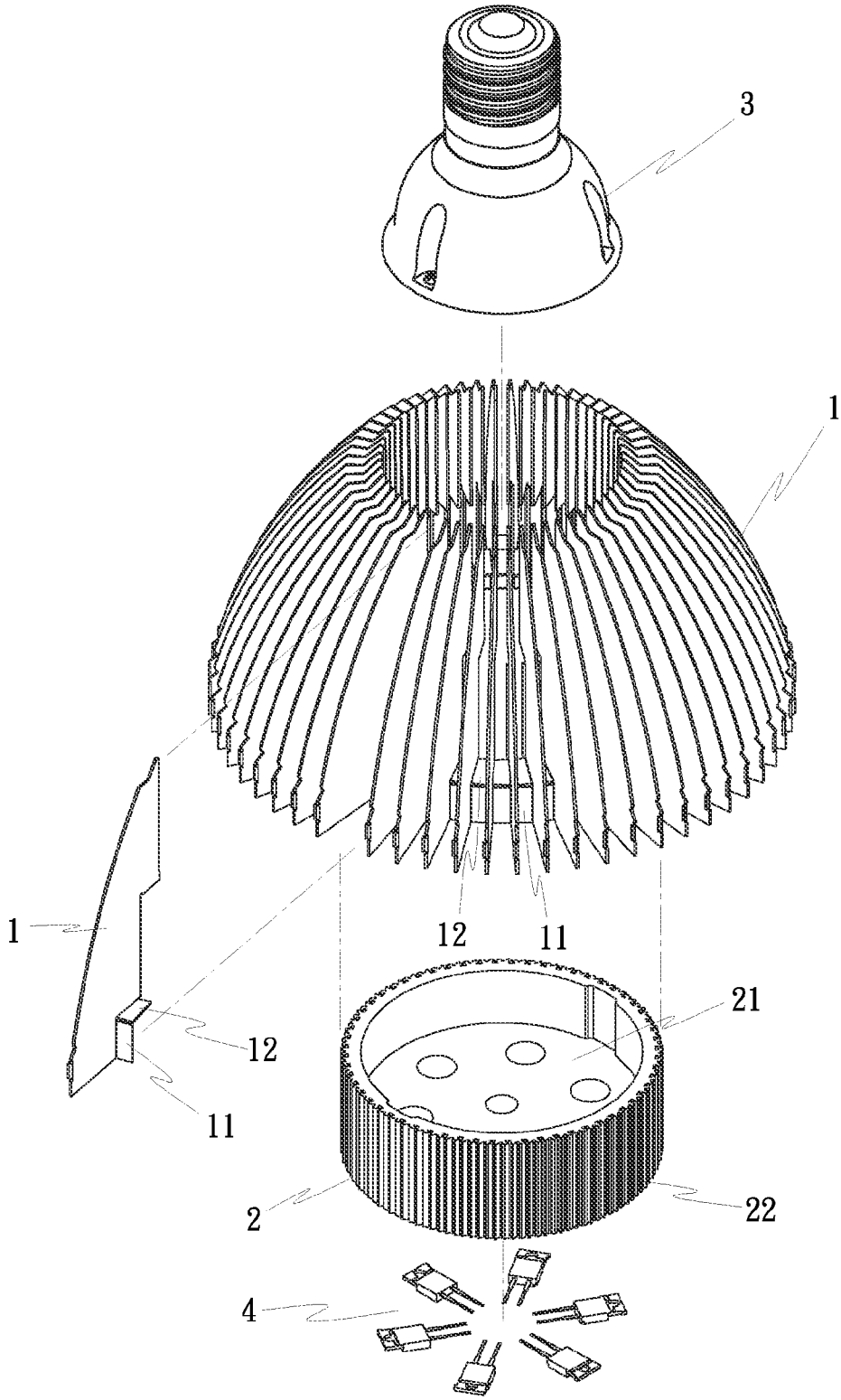
FIG. 1 is an exploded view of an LED projector lamp in accordance with the present invention.
Figure 2:
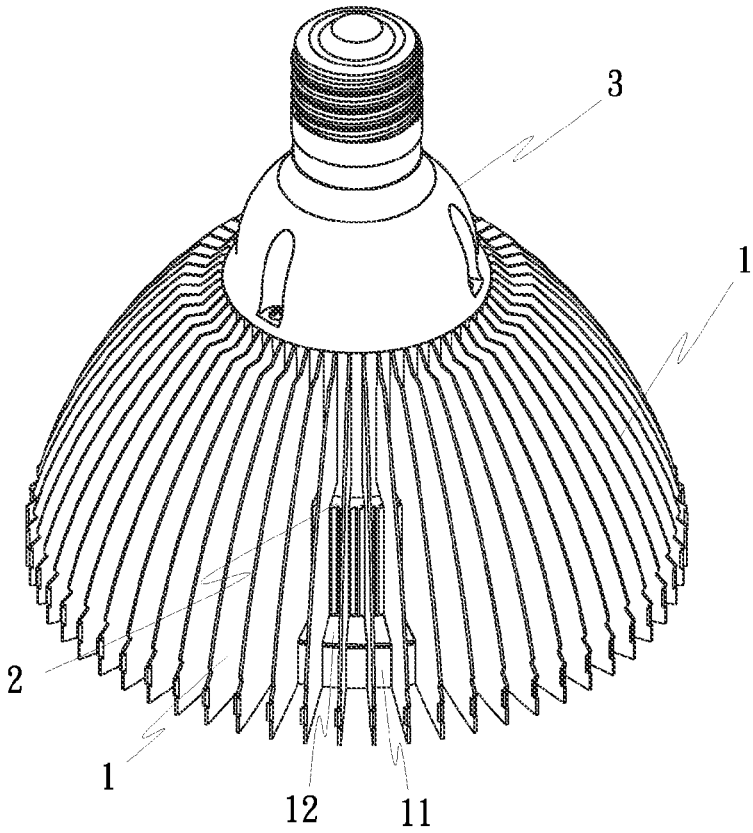
FIG. 2 is an elevational assembly view of the LED projector lamp in accordance with the present invention.
Figure 3:
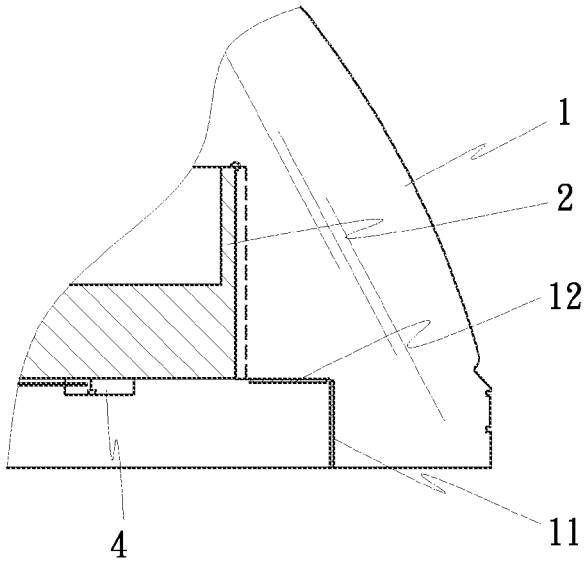
FIG. 3 is a sectional view of a part of the LED projector lamp in accordance with the present invention.

As shown in FIGS. 1 and 2, an LED projector lamp in accordance with the present invention comprises a plurality of radiation fins 1, a heat sink base 2 and an electric connector 3. The radiation fins 1 are radially arranged around the heat sink base 2 and joined with the electric connector 3.

Each radiation fin 1 has a first light shade 11 perpendicularly extending from one side around an inner bottom corner thereof.

The heat sink base 2 is connected with the electric connector 3 and a light source 4. The electric connector 3 is fixedly mounted at the top side of the heat sink base 2. The light source 4 comprises a plurality of LEDs (light emitting diodes) and is bonded to the bottom wall 21 of the heat sink base 2. The heat sink base 2 has a plurality of mounting grooves 22 equally spaced around the periphery for the mounting of the radiation fins 1. The radiation fins 1 are respectively press-fitted into the mounting grooves 22. Welding or any other bonding techniques may be employed to affix the radiation fins 1 to the heat sink base 2.

According to the aforesaid arrangement, the radiation fins 1 surround the heat sink base 2, and the first light shades 11 constitute a light shielding wall to prevent light leakage and access of flies and other vermin and to increase heat dissipation area.

Figure 4:
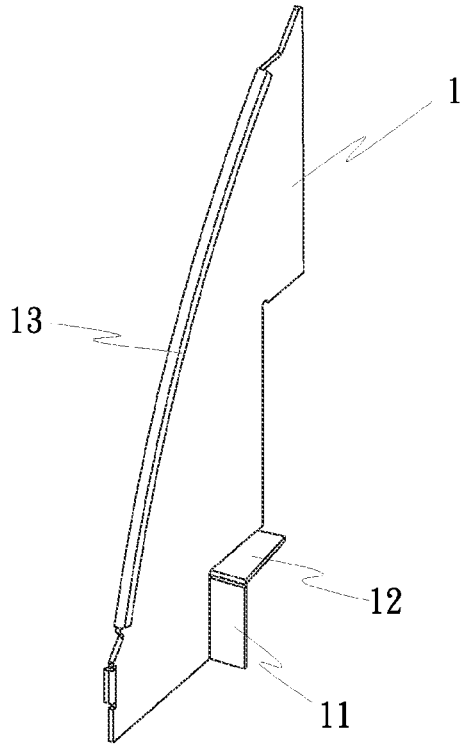
FIG. 4 is an elevational view of one radiation fin according to the present invention.

If the heat sink base 2 is made relatively smaller, the first light shades 11 of the radiation fins 1 may be insufficient to prevent light leakage. In this case, each radiation fin 1 is made to have a second light shade 12. As shown in FIG. 4, the second light shade 12 extends perpendicularly from one side of the respective radiation fin 1 around an inner bottom corner and connected to one end of the first light shade 11 at right angle. According to the embodiment shown in FIG. 1, the first light shade 11 is arranged vertically; the second light shade 12 is arranged horizontally. After installation of the radiation fins 1 in the heat sink base 2, the second light shades 12 constitute a second light shielding wall to prevent light leakage and access of flies and other vermin and to increase heat dissipation area. It is to be understood that the second light shade 12 of each radiation fin 1 is not a requisite design in this invention. The design of the second light shade 12 is determined according to the diameter of the heat sink base 2.

Figure 5:
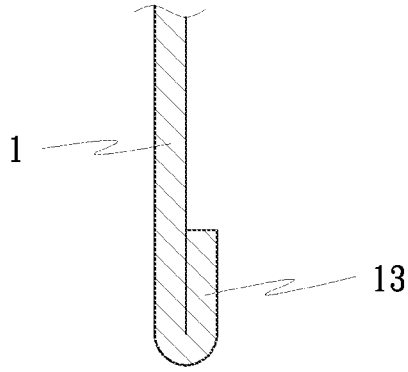
FIG. 5 is a sectional view of a part of one radiation fin according to the present invention.
Figure 6:
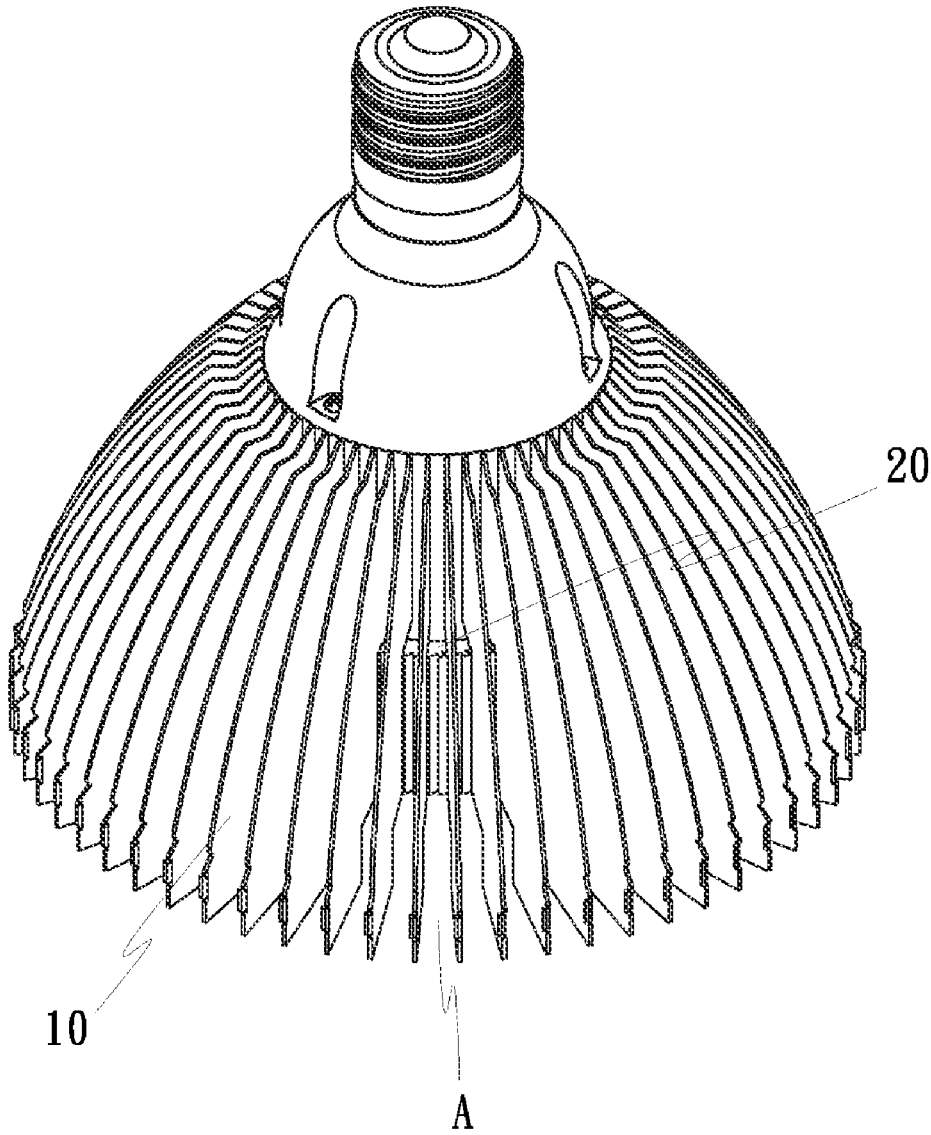
PRIOR ART FIG. 6
FIG. 6 is an elevational view of an LED projector lamp according to the prior art.

Referring to FIGS. 5 and 6, each radiation fin 1 has a folded outer edge 13, thereby smoothing the end face. Thus, the folded outer edge 13 will not cause accidental injury.

The electric connector 3 and light source 4 of the aforesaid LED projector lamp are known components. The electric connector 3 can be made in any of a variety of shapes and configurations. The number of LEDs of the light source 4 may be changed to fit different requirements.

Further, an extra decorative outer covering may be arranged around the heat sink base 1 to keep the heat sink base 1 from sight. A simple reinforcing ring may be fastened around the periphery of the heat sink base 1 to hold down the radiation fins 1 and to enhance the structural strength.

Further, the heat sink base 1 can be a hollow or solid member. Further, the heat sink base 1 is not limited to the cylindrical shape. It can be made in a triangular, rectangular or polygonal, or any of a variety of other shapes. Further, the shape, size, specification or arrangement of the radiation fins 1 may be changed without departing from the spirit and scope of the invention.

Although particular embodiment of the invention have been described in detail for purposes of illustration, various modifications and enhancements may be made without departing from the spirit and scope of the invention. Accordingly, the invention is not to be limited except as by the appended claims.

What is claimed is:

1. An LED projector lamp, comprising a heat sink base, a plurality of radiation fins radially arranged around said heat sink base, an electric connector affixed to said radiation fins at a top side above said heat sink base, and a light source bonded to a bottom wall of said heat sink base and electrically connected to said electric connector, wherein:

each said radiation fin has a first light shade extending perpendicularly from an inner side near a bottom side thereof, and a second light shade perpendicularly extending from the inner side thereof and connected to the first light shade at right angle, the first light shades of said radiation fins being in contact with one another and arranged around the periphery of said heat sink base to form a vertical light shielding wall; the second light shades of said radiation fins being in contact with one another and in contact with the periphery of said heat sink base to form a horizontal light shielding wall around the periphery of said heat sink base and perpendicularly connected to the vertical light shielding wall.

2. The LED projector lamp as claimed in claim 1, wherein said light source comprises a plurality of light emitting diodes.

3. The LED projector lamp as claimed in claim 1, wherein each said radiation fin has a folded outer edge.

4. The LED projector lamp as claimed in claim 1, wherein the heat sink base has a plurality of mounting grooves equally spaced around the periphery for mounting the radiation fins, respectively.

* * * * *